United States Patent [19]

Bernardi

[11] Patent Number: 4,795,554

[45] Date of Patent: Jan. 3, 1989

[54] PLCC CO-PLANARITY MEASUREMENT METHOD AND APPARATUS

[76] Inventor: Carl Bernardi, 21680 Shillingsburg Ave., San Jose, Calif. 95120

[21] Appl. No.: 50,613

[22] Filed: May 15, 1987

[51] Int. Cl.[4] ..... B07C 5/00; B07C 5/34

[52] U.S. Cl. ..... 209/546; 209/549; 209/573; 209/598; 209/604; 209/703; 209/707; 209/940

[58] Field of Search ..... 209/546, 549, 571, 573, 209/598, 600, 601, 604, 606, 702, 703, 707, 940

[56] References Cited

U.S. PATENT DOCUMENTS

| | | | |
|---|---|---|---|
| 2,321,191 | 6/1943 | Elmendorf | 209/703 X |
| 2,328,854 | 9/1943 | Shuman | 209/707 X |
| 2,549,296 | 4/1951 | Dilts | 209/598 X |
| 2,554,982 | 5/1951 | Hartley et al. | 209/598 X |
| 2,671,139 | 3/1954 | Dilts | 209/604 X |
| 4,090,610 | 5/1978 | Luginbuhl | 209/707 X |
| 4,138,018 | 2/1979 | Daebler et al. | 209/702 X |
| 4,161,251 | 7/1979 | Paul | 209/609 |

FOREIGN PATENT DOCUMENTS

| | | | |
|---|---|---|---|
| 0573608 | 2/1958 | Italy | 209/604 |

OTHER PUBLICATIONS

IBM Technical Disclosure Bulletin, "*Pin Detect and Reject*", *vol. 14, No. 2, Jul. 1971, p. 424.*

*Primary Examiner*—Robert B. Reeves
*Assistant Examiner*—Edward M. Wacyra
*Attorney, Agent, or Firm*—Allston L. Jones

[57] ABSTRACT

There is provided, a method and apparatus for determining if the lengths of all of the leads on all four sides of a PLCC packaged devices are within a selected tolerance of each other. To do so a relatively smooth surface across which the device is to be advanced is provided with that surface having a plurality of fingers affixed thereto. Each finger protrudes from the surface by an amount equivalent to the selected tolerance, with the plurality of fingers being in number at least equivalent to the number of leads on the longest side of the device to be tested. In addition, the surface is supported at a selected angle to horizontal. As the device is advanced across the surface in the direction of, and across the space spanned by, the fingers, the devices having all of its leads within the selected tolerance are differentiated from those devices that do not have all of their leads within the selected tolerance. Those devices which have all of its leads on its first two sides within the selected tolerance are rotatated and the second two sides are tested in the same manner as were the first two sides.

28 Claims, 6 Drawing Sheets

PLCC CO-PLANARITY MEASUREMENT METHOD AND APPARATUS

BACKGROUND OF THE INVENTION

This invention relates to the field of measurement of lead lengths of semiconductor devices and more particularly to the measurement of the relative length of leads of a PLCC (Plastic Leaded Chip Carrier) device to determine if the length of each lead is within a selected tolerance of the length of every other lead.

The PLCC package configuration 10 of FIG. 1 for semiconductor devices is a recent innovation wherein the device includes leads 13 on all four sides of the package 12. This is done to increase the package density on the circuit board, or, in other words, to minimize the amount of motherboard real estate that is required to execute an overall instrument. PLCC packages are typically square, however there are a few rectangular configurations, with each side having four to thirty-one pins.

Each lead 13 of a PLCC package 10 is bent downward along the side of package 12 and then bent back under the package in the shape of the letter "J" as shown in FIG. 2. (some manufactures use "gull wing" shaped leads as apposed to "J" shaped leads) These devices are installed on a circuit board by soldering the leads directly to conductive pads at the ends of traces on the circuit board without the leads passing through the board. To accomplish this the leads must each be of a length that is within a selected tolerance of each other to insure that all of the leads will be soldered to the circuit board during the soldering operation. The lead length tolerance that is currently required in the industry is 0.004 inches or less.

At the present time very elaborate and expensive means are used to measure the lead length of each lead on a PLCC package before it is soldered in place on a circuit board. Those means include microprocessor controled laser measurement systems that measure the actual length of each lead and then compares those lengths with each other to determine if any one or more of the leads is out of tolerance. There are two drawbacks to the use of these devices, they are expensive to purchase and slow to utilize. They provide unnessary information for those units which are within tolerance which are typically the majority of the units produced. The laser measurement systems are indeed overkill for this application.

What is needed is a method and apparatus that is easy to use, provides the necessary yes/no test for identifing the PLCC units with what ever shaped leads that are within tolerance, and is relatively inexpensive to implement and use. The present invention is such a method and apparatus.

SUMMARY OF THE INVENTION

In accordance with the preferred embodiments of the present invention there is provided, a method and apparatus for determining if the lengths of all of the leads on all four sides of a PLCC packaged device are within a selected tolerance of each other. To do so a relatively smooth surface across which the device is to be advanced is provided with that surface having a plurality of fingers affixed thereto. Each finger protrudes from the surface by an amount equivalent to the selected tolerance, with the plurality of fingers being in number at least equivalent to the number of leads on the longest side of the device to be tested. In addition, the surface is supported at a selected angle to horizontal.

A starting position on the surface is designated as the location to place the device to be tested so that each of the leads on the side of the device closest to the fingers is opposite a different one of the fingers when the device is placed on the surface in the defined position. As the device is advanced across the surface in the direction of, and across the space spanned by, the fingers, the devices having all of its leads within the selected tolerance are differentiated from those devices that do not have all of their leads within the selected tolerance. This differentiation is accompliched in the first embodiment by identifying the devices that traverse a number of fingers equivalent to the number of leads on a side as those that have leads that are within tolerance and any devices that fall from the fingers before having traversed a number of fingers equivalent to the number of leads on a side as rejects. In the second embodiment, the differentiation is accomplished by identifing the devices who's leads depress all of the fingers aligned with the leads on its horizontal sides twice as those that have leads that are within tolerance and any device who's leads fail to depress at least one of the fingers aligned with its leads twice as rejects. Those devices which have all of its leads on its first two sides within the selected tolerance are rotated and the second two sides are tested in the same manner as were the first two sides.

FIGS. *3a* and *b* are magnified side plan views of a PLCC semiconductor package and a portion of the first embodiment of the present invention to illustrate the measurement technique thereof.

Figure 4:
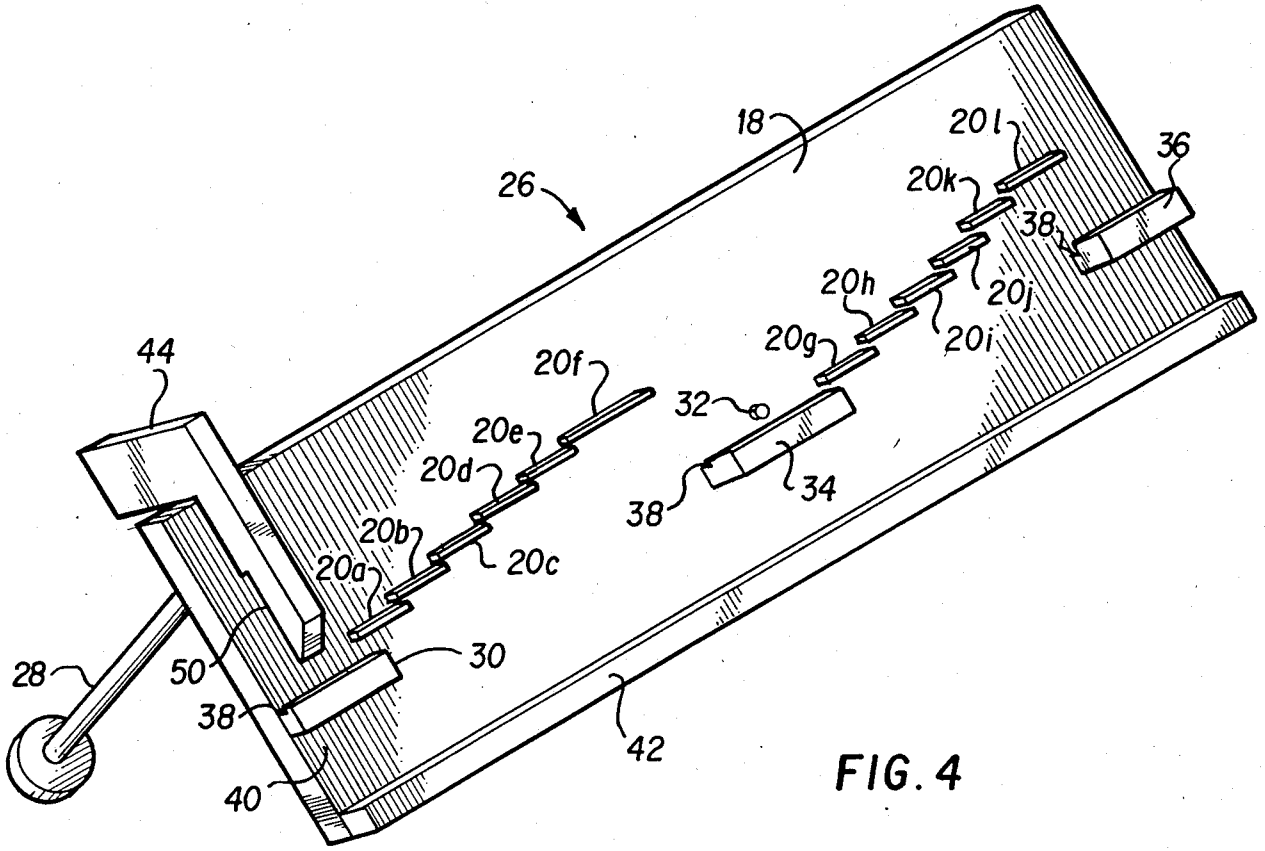

FIG. 4 is a perspective view of a first embodiment of the present invention.

Figure 5:
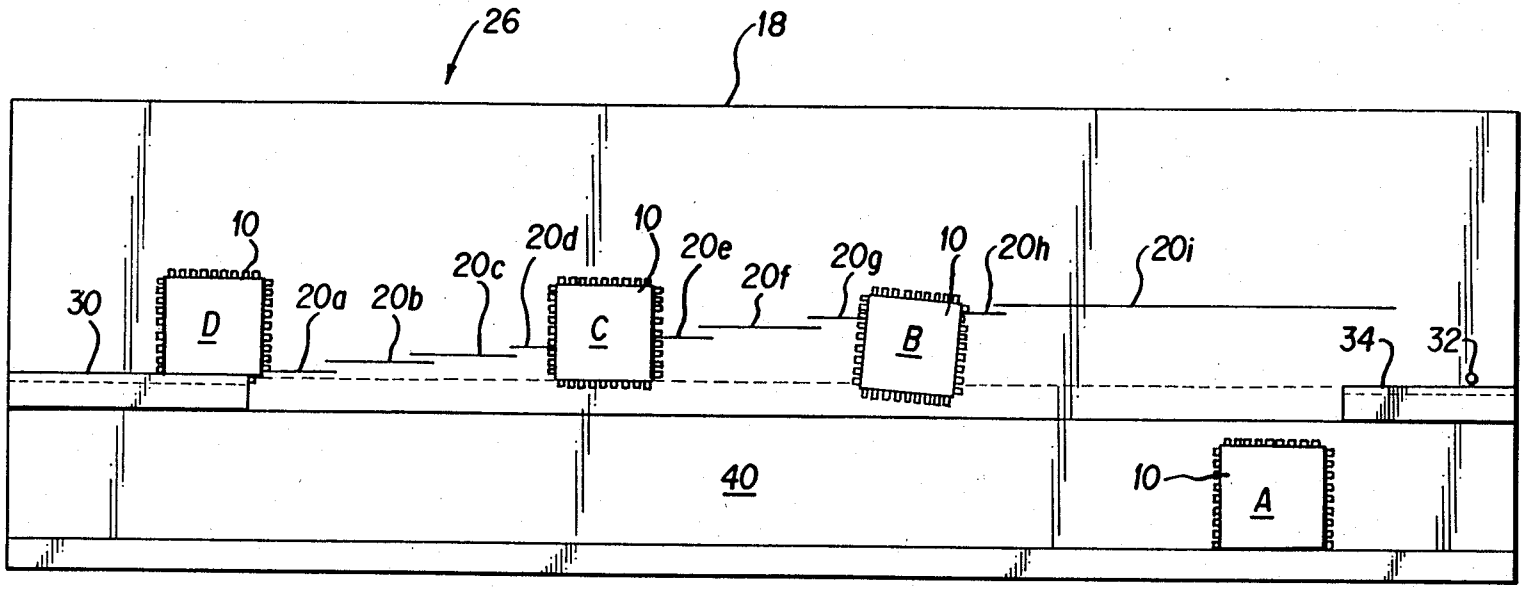

FIG. 5 is a top plan view of the embodiment of the present invention of FIG. 4 wherein its operation is illustrated.

Figure 6:
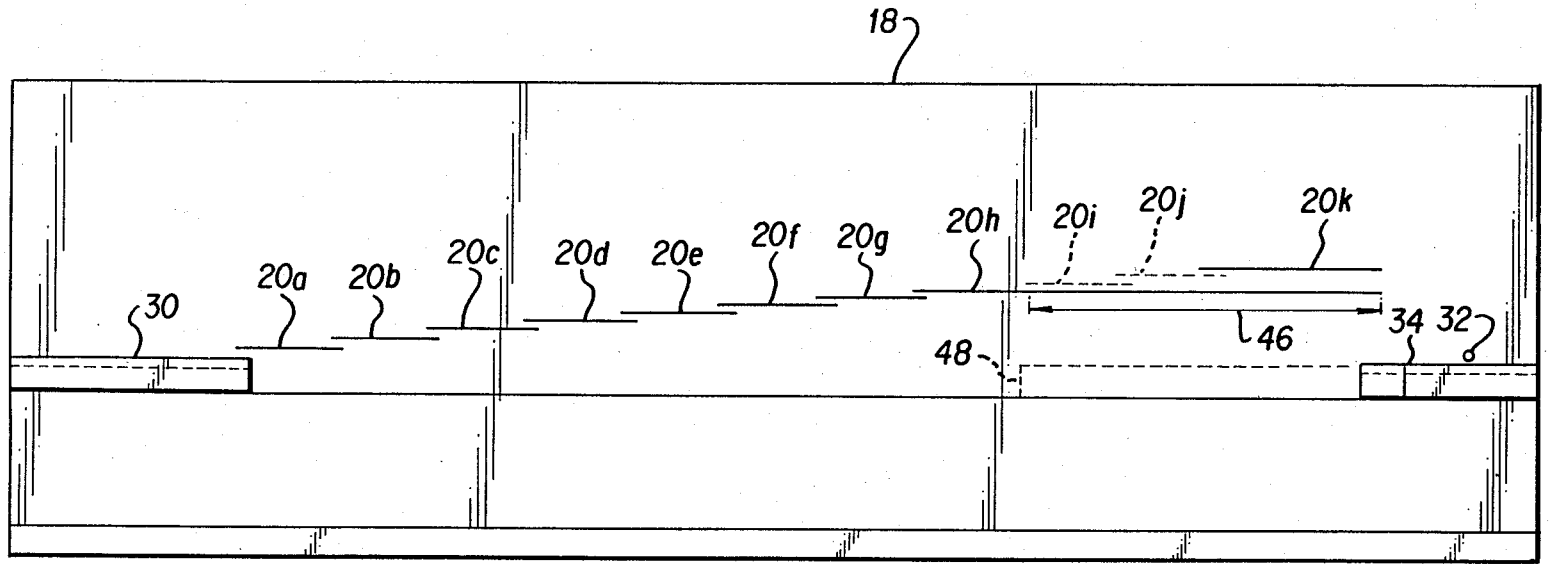

FIG. 6 is a top plan view of the embodiment of the present invention of FIG. 4 wherein additional features are illustrated.

FIGS. *7a* and *7b* are a top plan view of the embodiment of the present invention of FIG. 4 wherein a walking beam is shown for advancing the packages under test thereacross.

Figure 8:
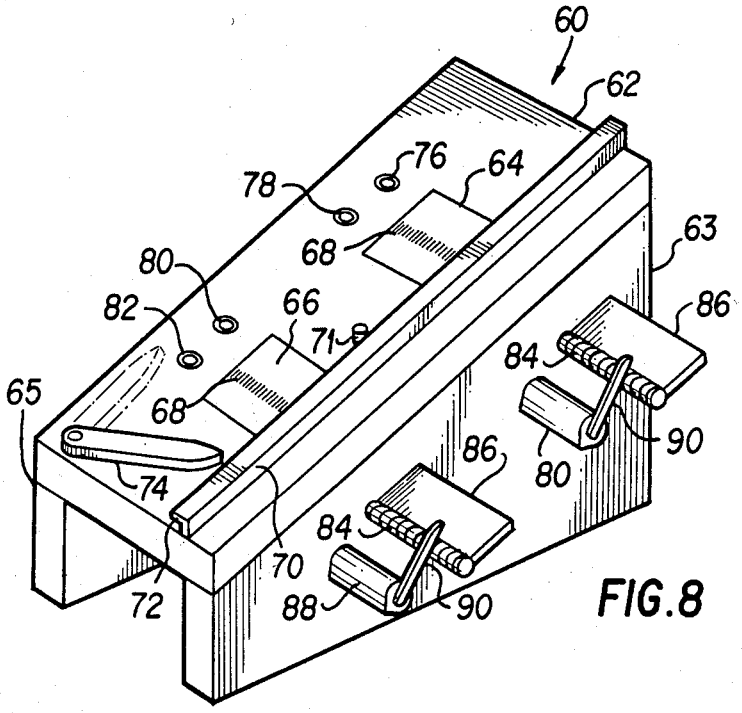

FIG. 8 is a perpective view of a second embodiment of the present invention.

Figure 9:
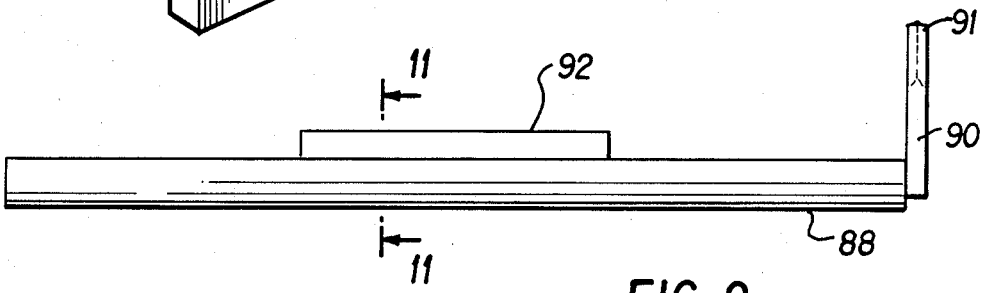

FIG. 9 is a plan view of a cam bar of the embodiment of the present invention of FIG. 8.

Figure 10:
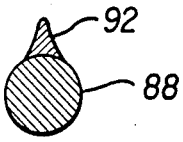

FIG. 10 is a cross-sectional view of the cam bar of FIG. 9.

Figure 11:
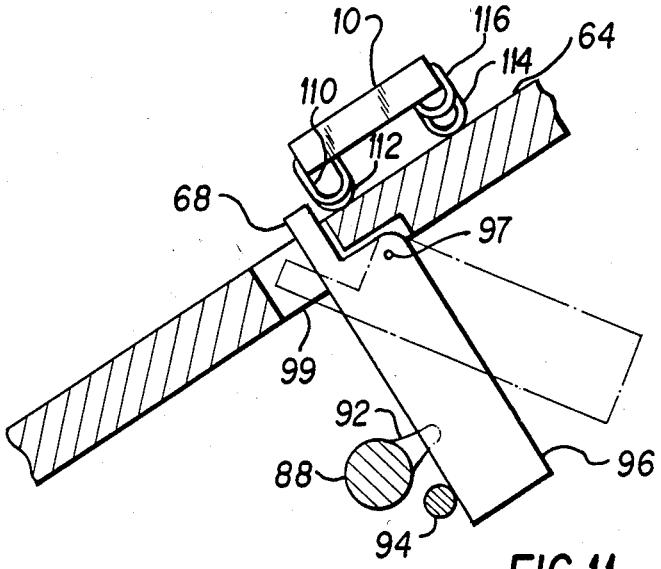

FIG. 11 is a simplified plan cross-sectional view of the embodiment of the present invention of FIG. 8 showing the measurement plate and related hardware.

Figure 12:
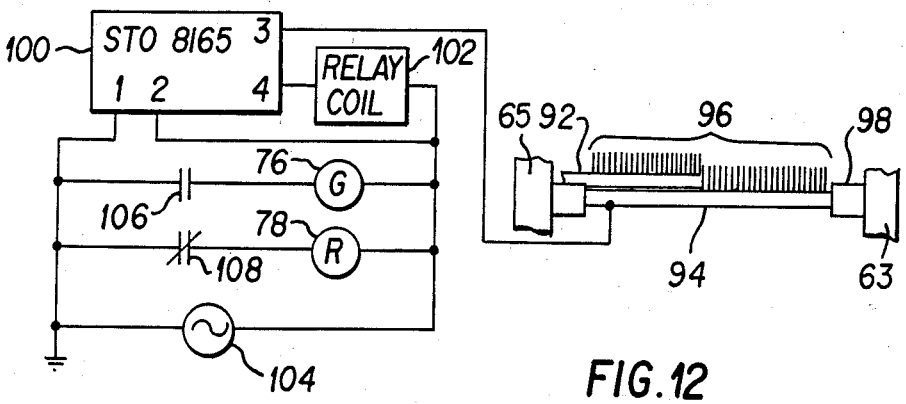

FIG. 12 is a schematic diagram of the test circuit and display of the embodiment of the present invention of FIG. 8.

BRIEF DESCRIPTION OF THE PREFERRED EMBODIMENTS

PLCC semiconductor packages come in a variety of sizes, from the smallest with as few as 20 leads (6×4) to the largest with 124 leads (31×31). Each lead is created from the flat lead frame on which the semiconductor chip internal to the package is mounted. The leads are created by bending them downward along the outside of the package 12 and then into the shape of the letter "J" with the short stem thereof extending beneath the edge of the PLCC package. In the PLCC configuration each lead is approximately 0.021 inches wide on 0.050 inch centers, i.e. from lead center to adjacent lead center. Since these devices are to be soldered to the surface of the printed circuit board that is to receive them without the leads passing through the board, each lead must be long enough to insure that it will be soldered to the printed circuit board during the soldering process. The wetting properties of solder between two metallic surfaces will permit the solder to fill a small gap between the lead and the surface of the circuit board, thus each of the leads on the PLCC package do not have to be of the same length, a tolerance on their lengths from one to the other is allowable. To insure that all of the leads on a PLCC package are soldered to the circuit board during the soldering process, a maximum tolerance of 0.004 inches difference in individual lead lengths on such a package is the typically selected maximum, i.e. the maximum allowable difference between the lengths of the shortest lead and the longest lead shall not exceed 0.004 inches.

As is known from geometry, three points determine a plane, thus the orientation of the PLCC package will be determined by its three longest leads. While it is physically possible that more than three, including all, of the leads will be of the same length, it is highly improbable. Thus, when a PLCC package is placed on a smooth surface there will be a gap between the surface and the ends of each of the leads other than the three leads that are defining the support plane for the package. Both of the embodiments of the present invention disclosed herein make use of that physical phenomenon. In each of the prototype units of the embodiments of the present invention the test surface was selected to be a number 4, 6 or 10 surface (a surface having peaks and valleys that have an elevation difference of no more than 4, 6 or 10 microinches, e.g. for a number 4 surface that is 0.000004 inches). That is on the order of 1000 times smoother than the tolerance on the lead length of the PLCC packages. It is clear that a smooth surface to measure the lead lengths of the PLCC devices is needed, however it does not necessarily have to be that smooth to perform the test. For several reasons it is desirable to use a relatively smooth surface for a test fixture. First, the cost of producing such a surface using chromed steel is not that expensive. Second, the PLCC packages are slid across the test surface of each of the fixtures of the two embodiments of the present invention which could cause unnecessary wear on the ends of the PLCC leads without the use of a smooth surface.

The first embodiment of the present invention is shown in FIG. 4. Fixture 26, having a smooth surface 18, is supported by a pair of legs 28 at an angle from horizontal that is sufficient to cause a PLCC device that has one or more short leads to slide down into reject tray 40. During experiments with a prototype 30 degrees was found to be a functional angle for that purpose. At the left side of fixture 26 is a starting rest 30. Across surface 18 of fixture 26, in a stair step fashion, are two sets of blades 20 (20*a–f* and 20*g–l*) which extend vertically outward from surface 18 to a height that is the selected lead length tolerance of the PLCC devices to be tested. Blades 20 are inserted from the rear of surface 18 and then ground to the desired height or length. Each blade is positioned 0.050 inches further up the face of surface 18 with each blade overlapping the previous blade and the rests 30, 34 and 36 by some minimal distance to insure that adjacent leads on the device under test are captured by the next blade before the lower lead clears the previous blade. In the prototype unit the overlap was selected to be 0.030 inches. In addition, there is a one to one relationship between the number of leads on the side of the PLCC device being tested and the minimum number of blades in that half of the test fixture, e.g. the fixture of FIG. 4 is for testing a PLCC device no larger than 6×6 since there are six blades, 20*a–f*, in the first half and six blades, 20*g–l*, in the second half. In the central portion of surface 18 is a intermediate rest 34 with a turning pin 32 thereabove extending outward from surface 18. Along the right edge of surface 18 is final rest 36. To advance the PLCC devices under test across fixture 26, as will be described below, is a manual indexer 44. Another feature shown in this figure is the "L" shape, or under-cut, 38 of rests 30, 34 and 36. Under-cut 38 is provide so that only the plastic case portion 12 of the PLCC devices comes into contact with each of rests 30, 34 and 36 to prevent unnecessary wear on the sides of the leads of those devices.

Figure 1:
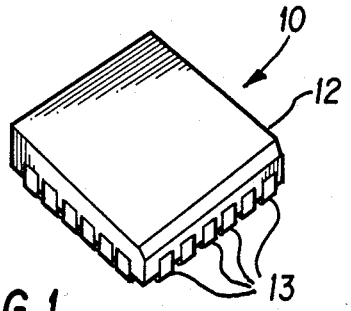
FIG. 1 is a perspective view of a PLCC semiconductor package.
Figure 2:
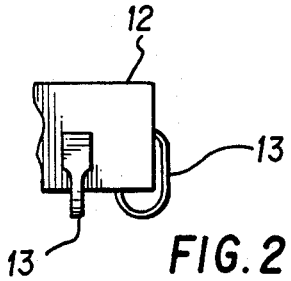
FIG. 2 is a magnified partial side plan view of a PLCC semiconductor package.
Figure 3A:
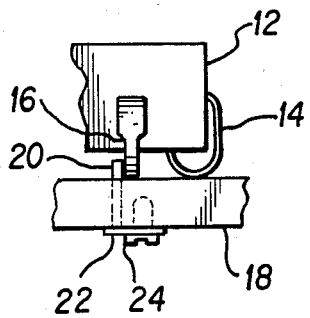
Figure 3B:
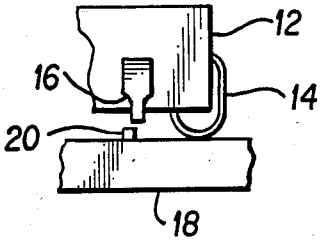

An example of the operation of the first embodiment of the invention is presented in FIG. 5. In FIG. 5 there is shown the first half of the fixture 26 with nine blades 20*a–i*, which is similar to that shown in FIG. 4. In this figure there are four devices 10A–D each with nine leads on each side, at various stages of testing for the length of their leads which in this view are oriented vertically. A PLCC device is started on the left side by placing it on starting rest 30 with its side having the same number of leads in the vertical direction as there are blades 20 in that half of the fixture 26. As device 10D is advanced to the right, the first lead on its right side hangs on blade 20*a* if it is within the selected tolerance of the three longest leads on the package (see FIG. 3*a*, lead 16 and blade 20). As device 10D is advanced further to the right the first lead on the left edge will hang on by blade 20*a* if it is within tolerance. At some point as device 10D is advanced, the second lead on the right will pass above and hang on blade 20*b*, and the first lead on the right will clear blade 20*a*. For testing purposes it is not necessary that the same number lead on both sides of the device 10D be on the same blade 20 at the same time, though they may be. This can be seen with respect to device 10C which has been advanced to the point where the fifth lead on the right side is hanging on blade 20*e* and the fourth lead on the left side is hanging on blade 20*d*. That being the case, device 10C remains above the dashed line in FIG. 5 indicating that all of the leads of that device tested up to that point (four on the right and three on the left) are within the length tolerance represented by the height of blades 20. Moving on to device 10B it can be seen that it extends below the dashed line in FIG. 5 indicating that one or more of its leads were more than the height of blades 20 shorter than the longest leads of device 10B. For device 10B, the ninth lead on the right side is hanging on blade 20*h* (the eighth blade from the left) and the seventh lead on the left is hanging on blade 20*g* (the seventh blade from the left). Thus, one of the leads on the right side of device 10B is more than the height of the blades shorter than the longest leads on the device. When a lead is shorter than allowed, that lead will not hang on the blade disposed to receive it resulting in the next lead of sufficient length on that side of the device hanging on that blade after the device has turned downward in response to the slope of fixture 26 and thus the device extends below the dashed line. As a reject device, such as device 10B, is further advanced, it will fall to reject tray 40 as has device 10A. Again referring to device 10B, as it is advanced further to the right the ninth lead on the right side will eventually clear the end of blade **20*h* and since the ninth lead is below blade 20*i*, the ninth blade, it will not hang on blade 20*i*. Gravity will then cause device 10B to further rotate in the clockwise direction bringing the leads along the top side of device 10B into contact with blade 20*i*, however, because of the slope of fixture 18 and the radius of the leads along the top side (see FIG. 3*b*), the top side leads will ride over blade 20*i* without hanging thereon, resulting in device 10B falling to reject tray 40. If the device 10 is not a reject, then it will advance completely across the blade region and arrive at intermediate rest 34 without having extended below the dashed line in FIG. 5**.

Referring again to FIG. 4, as a device 10 is then advanced across intermediate rest 34, the lower right corner of the device, between the corner of its plastic case 12 and the first lead on the right side, comes into contact with turning pin 32. As the device is further advanced to the right, it turns clockwise through an angle of 90 degrees (see FIG. **7*a*, device 10F) with its top, bottom, right and left sides becoming its right, left, bottom and top sides, respectively. The device is then advanced across the second half of fixture 26 in the same manner as was described for the first half of the fixture (FIG. 5) with the former top and bottom sides being checked on the second half. It should be noted at this point that it is not necessary to check the leads on the device from the bottom up, the technique works equally well if the first blade on the left is disposed to receive the lead furthest up the vertical sides of the device working down to the furthest down on the right, or in any sequence for that matter. Thus the test can be conducted either to the right or to the left. Carrying this one step further, it can be seen that, particularly for a square PLCC device, only one half of the fixture shown in FIG. 4** is necessary to test all four sides of the device if the device is first advanced across the first half of the fixture in one direction, turned 90 degrees, and then advanced back across the same blades in the opposite direction.

To this point in the discussion the illustrated fixture has been specifically for the configuration of the device to be tested, i.e. the number of blades has been equal to the number of leads on the side of the device being tested. By making some of the blades removable and the intermediate and final rests 34 and 36 extendable, a universal fixture can be designed. Since a PLCC package can have four to thirty-one leads on a side, the four blades closest to the rests down the face of fixture 26 on each half of the fixture can be permanent blades and blades five through thirty-one can be removeable. FIG. **3*a* shows a blade 20 having a tee section 22 that is affixable through the back side of surface 18 by means of screw 24. FIG. 6 shows a surface 18 that includes up to eleven blades for testing a PLCC device with up to eleven leads on a side. This view includes initial and intermediate rests 30 and 34, regular length blades 20*a*–*g* and 20*k*, and extended length blade 20*h*. As shown in this view the fixture 26 has been modified to test the lead lengths of a PLCC device having eight leads on a side instead of eleven. To accomplish this blades 20*i* and *j* have been removed so that they do not interfere with the leads along the top edge of device 10 as it is advanced past their positions, blade 20*h* has been replaced with a longer blade 20*h* which extends across the distance of regular blade 20*h* plus the distance 46 traversed by the combination of the lengths of regular blades 20*i*–*k*. Fixture 26 could also be modified to test eight leads on a side devices by retaining regular width blade 20*h*, removing blades 20*i* and *j*, and replacing intermediate rest 34 with a longer one that additionally traverses distance 46, or by installing an extension 48 to intermediate rest 34. This can be implemented as are removeable blades 20 by being screwed in place from the back of surface 18. To complete the modification, similar changes could be affected on the second half of surface 18**.

The first embodiment of the present invention can be utilized either manually or automatically. In FIG. 4 a manual indexer is shown decending over, and mating squarely with, the top edge of fixture 18. The side of indexer 44 is also square with the surface 18 and is disposed to mate with the left side of a PLCC device 10 to advance it across surface 18 while the leg of indexer 44 is kept square with the top edge of the fixture. The downward pointing end of indexer 44 is also formed to not make contact with surface 18 so that it clears blades 20 as it is advanced across surface 18. Indexer 44 is advanced approximately one blade 20 length, then backed off slightly to allow the device under test to hang freely or to rotate downward without being influenced by indexer 44, with these steps being repeated until the device under test either completely traverses surface 18 or falls into reject tray 40.

Figure 7A:
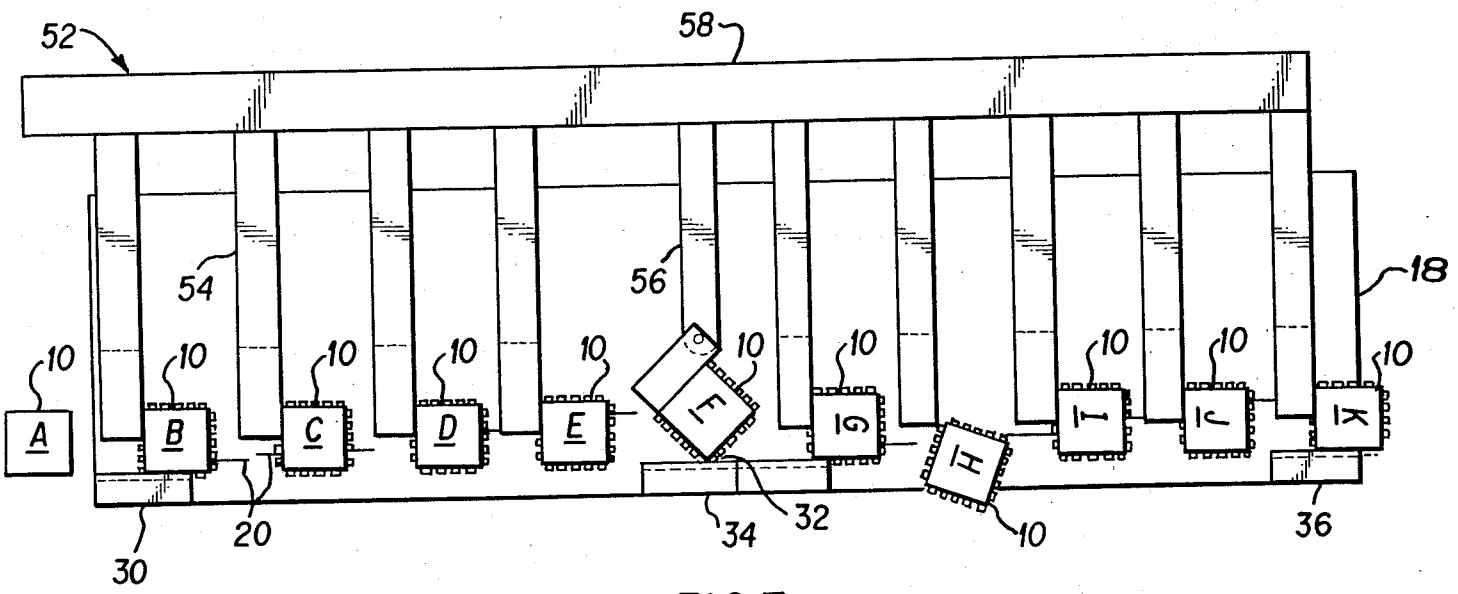
Figure 7B:
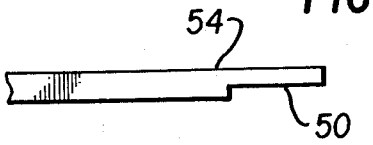

In FIG. **7*a* a walking beam 52 is shown to advance a plurality of devices 10 across the fixture simultaneous with the devices 10 being evenly spaced apart from each other. Devices 10 are fed into the fixture from the left with a first leg of the beam mating with it and then advancing all of devices 10A–K to the right a selected distance. Beam 52 is then reversed a small distance to the left, lifted above the fixture and the devices under test, advanced further to the left, and then returned to the surface of the fixture with each leg assuming the space between devices 10 previously occupied by the leg to the left thereof on the beam. The beam is then advanced to the right again with the process being continued until all of the devices that are to be tested are processed. The tips of each of legs 54 and 56 of beam 52 are also spaced apart from surface 18 as is indexer 44 (see FIG. 7*b*). Each of legs 54 are affixed to the top bar 58 of beam 52 and are non-bending vertically. Leg 56, however, is articulated with a torsional spring in its articulation joint to bias it into a straight configuration, to cause device 10 to rotate about turning pin 32 on intermediate rest 34, as discussed above. Since the devices on the second half of the fixture are being, or have been, turned through 90 degrees, the letters on devices 10F–K are shown rotated from the letters on devices 10A–E. Additionally, device 10H is shown extending down passed the top edge of rests 30, 34 and 36** and therefore it is a reject unit that is falling into the reject tray (not shown).

Either of the means for advancing devices 10 across surface 18 shown in FIGS. 4 and **7*a*** can easily be automated, as can the delivery and removal of devices to and from the fixture, including the removal of rejected devices separately from those that pass inspection. The concept and theory of the first embodiment is not dependent on the incorporation of a particular delivery and removal system.

The slope angle of the test surface, the smoothness of that surface and the length of each of the blades all interact in the determination as to how fast the devices under test can be processed across the first embodiment fixture.

FIGS. 8–12 illustrate the fixture of the second embodiment and its operation which can be used to measure lead length for whatever shape the leads have. For purposes of illustration, only "J" bend leads are discussed in detail. In FIG. 8 there is shown a perspective view of a fixture 60 having a sloping surface 62 down which the PLCC devices 10 will be advanced against indexing rail 70. Like rests 30, 34 and 36 in the first embodiment, rail 70 includes an under-cut 72 so as not to damage the leads of devices 10 as they are advanced in contact with indexing rail 70. Forming a part of surface 62 are test plates 64 and 66 through which tabs 68 extend above surface 62. Tabs 68 are disposed to contact the leads of the device being tested, however, the length of tabs 68 above surface 62 is equivalent to the tolerance for the difference in the acceptable lead lengths of device 10 from its shortest to its longest. Since a PLCC device may have as many as thirty-one leads on a side, each of test plates 64 and 66 have thirty-one individual tabs 68 extending out therefrom with the tabs spaced 0.050 inches between centers. In the prototype, tabs 68 were made of 0.008 inch thick stock with each slot 99 (see FIG. 11) through which each tab 68 extends is 0.010 inches wide. Between test plates 64 and 66 is a device turning pin 71 that functions as does turning pin 32 in the first embodiment (FIG. 4). At the bottom end of sloping surface 62 is a moveable vane 74 for sorting the reject devices from the good ones. Vane 74 is shown in solid outline in one of its positions and in dashed outline in its other position.

Extending outward from the side 63 of fixture 60 are two sets of identical items, each set functioning in conjunction with one of the two test plates 64 and 66. Each of these sets include an index bar 84, a scale 86 and a cam bar 88. Each of cam bars 88 are journaled through each of sides 63 and 65 of fixture 60. In FIGS. 9 and 10 bar 88 is shown to include a centrally located cam 92 affixed thereto and a lever 90 with a knife edge on its far end on the underside as shown in FIG. 9 affixed to one end of bar 88.

Referring to FIG. 11, tab 68 is shown to be the upper portion of a plate 96, each of which are swivelly mounted on a pin 97 below test plate 64 or 66. Due to the slope of surface 60 and gravitational action, plate 96, when tab 68 is undisturbed, assumes the position shown in solid outline resting against electrically conductive bar 94. When the longest lead on device 10 rides over tab 68, tab 68 is depressed flush with test plate 64 causing plate 96 to swivel counter-clockwise around pin 97 to assume the position depicted by the dashed outline in FIG. 11. If the lead on device 10 that is passing over test plate 64 and tab 68 is within tolerance, tab 68 may be depressed less than all the way, thus plate 96 will not swivel to the extent depicted in dashed outline, however, the contact between plate 96 and bar 94 will be broken. If the lead on device 10 is out of tolerance (too short), then tab 68 will not be distrubed and plate 96 will remain in the position shown in solid outline in FIG. 11.

When a PLCC device is to be tested, the tabs 68 that correspond to leads which are not present on that device are lifted from bar 94 by cam 92 on bar 88 below test plate 64 and 66. Note, for a square PLCC device the same tabs furthest out from rail 70 will be lifted, however, for a rectangular PLCC device a different collection of tabs 68 will be lifted from each of the bars 94 corresponding to each of the test plates 64 and 66. Bar 88 and the associated indexer 84 and scale 86 are provided to perform this function. Each of indexers 84 has a set of grooves 0.050 inches apart to correspond to the lead spacing of the PLCC devices (indexers 84 can be implemented very simply by means of a 20 threads per inch screw which has 0.050 inches between threads). The corresponding scale 86 has markings to indicating the number of tabs 68 to be left in position (in electrical contact with the associated bar 94) to test a device with that number of leads on the associated side of device 10 to be tested by the plate and tabs associated therewith. Each of the markings on scale 86 are aligned with a groove on indexer 84. As bar 88 is moved laterally beneath surface 62, cam 92 is brought adjacent to a varing number of plates 96. Thus when knife edge 91 on lever 90 of bar 88 is set in a groove of indexer 84 opposite the number leads on the associated sides of a device to be tested, all of the plates 96 farther from rail 70 than that number are lifted by cam 92 and held away from bar 94.

Referring next to FIG. 12 there is shown schematically the test circuit associated with each of the test plates 64 and 66. Included in this view are plates 96 some of which are in contact with electically conductive bar 94 and the remainder of which are being held away from bar 94 by cam 92 of bar 88. For simplicity only, cam 92 is shown without the remainder of bar 88. Bar 94 is shown being supported by non-conductive brackets 98 from sides 63 and 65 of fixture 60. The left side of the figure shows an electrical circuit containing a touch switch 100 (Model STO 8165 normally closed touch switch was used in the prototype), a relay coil 102, relay contact pairs 106 and 108, green and red lamps 76 and 78, respectively, and an AC power source 104. Touch switch 100 has its power terminals 1 and 2 connected across the AC power source 104 with terminal 1 also connected to chassis ground—the main body of fixture 60, including plates 96. The touch switch control terminal 3 of switch 100 is connected to electrically isolated bar 94. Relay coil 102 is connected between terminal 4 of switch 100 and the ungrounded side of the AC power source 104, the green lamp is connected serially with the normally open contacts 106 of the relay across the AC power source 104, and the red lamp is connected serially with the normally closed contacts 108 of the relay across the AC power source 104. Thus, in the quiescent state and when a reject device 10 passes over test plate 64 or 66 at least one of plates 96 remains in contact with bar 94, maintaining ground potential on the control terminal 3 of touch switch 100. With ground potential on the control terminal 3, terminal 4 remains open in switch 100 and relay coil 102 remains unenergized, therefore, the red lamp 108 remains illuminated indicating that at least one lead on the device 10 is out of tolerance, and thus the device is a reject. When a device 10 passes over test plate 64 or 66 and all of its leads are within tolerance, all of plate 96, not already raised by cam 92, are raised from bar 94 removing ground potential from control terminal 3 of touch switch 100. That causes switch 100 to apply ground potential to its terminal 4 which in turn causes relay coil 102 to be activated, further causing relay terminals 106 to close and relay terminals 108 to open, resulting in green lamp 76 being illuminated for as long as there is no contact between plates 96 and bar 94. In other words, green lamp 76 flashes on when a row of leads on a device under test that are all within tolerance passes over tabs 68 of test plate 64 or 66. Since each test plate is used to test the rows of leads on opposite sides of the same device, there must be two green indications for an acceptable device from test plate 64. The device is then turned around pin 71 and the two rows of leads on the other two sides are tested similarly by the second test plate 66. Thus a total of four green indications is required to signal a good device.

The second embodiment of the present invention can also be implemented either manually or automaticly. Several means for advancing devices 10 across surface 62 can easily be automated, as can the delivery and removal of devices to and from the fixture, including the removal of rejected devices separately from those that pass inspection. The concept and theory of the second embodiment is also not dependent on the incorporation of a particular delivery and removal system.

The slope angle of the test surface, the smoothness of that surface and the length of each of plates 96 beneath surface 62 all interact in the determination as to how fast the devices under test can be processed across the second embodiment fixture.

While the invention has been illustrated and described in two preferred embodiments, it should be understood that the invention is not limited to the precise details illustrated herein and described above since the same may be carried out in other ways falling within the scope of the invention as illustrated and described. The scope of the present invention is only limited by the scope of the following claims.

What is claimed is:

1. A method for determining if the lengths of all of the leads on all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said method comprising the steps of:

a. providing a relatively smooth surface across which the device is to be advanced;

b. affixing a plurality of fingers in over-lapping alignment to the surface of step a. with each finger protruding from said surface by an amount equivalent to the selected tolerance, said plurality of fingers being in number at least equivalent to the number of leads on the longest side of the device;

c. supporting the surface of step a. at a selected angle to horizontal;

d. defining a position on the surface so as to place each of the leads on two of the sides of the device closest to the fingers opposite a different one of the fingers when the device is placed on the surface in the defined position;

e. advancing the device from the position of step d. across the surface in the direction of, and across the space spanned by, the fingers;

f. differentiating devices that have undergone step e. wherein the length of all of the leads traversing the fingers are within said tolerance from those wherein the length of at least one of the leads on either one of the two sides is not within said tolerance by identifying the devices that traverse a number of fingers equivalent to the number of leads on one of said sides as those that have leads that are within tolerance and any devices that fall from the fingers before having traversed a number of fingers equivalent to the number of leads on one of said sides as rejects;

g. rotating the devices identified in step f. as being within tolerance through 90 degrees; and h. repeating steps d. through f.

2. A method as in claim 1 wherein:

said surface of step a. has a straight bottom edge on which it rests when supported as in step c.; and said fingers of step b. are affixed substantially parallel to the bottom edge of the surface.

3. A method as in claim 2 wherein the fingers of step b. are oriented across the face of the surface in a stair-step fashion and spaced-apart from each adjacent other finger by a distance that is substantially equal to the distance that each lead is spaced-apart from each adjacent other lead on the same side of the device.

4. A method for determining if the lengths of all of the leads on all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said method comprising the steps of:

a. providing a relatively smooth surface across which the device is to be advanced;

b. mounting rotatabally a plurality of spaced-apart, linearly aligned, fingers to said surface to protrude therefromabove by an amount equivalent to the selected tolerance, said plurality of fingers being at least equivalent in number to the number of leads on the longest side of the device;

c. supporting the surface of step a. at a selected angle to horizontal;

d. defining a position on the surface above the fingers of step b. so as to place each of the leads on a side of the device closest to the fingers opposite a different one of the fingers when the device is placed on the surface in the defined position;

e. advancing the device from the position of step d. across the surface in the direction of, and across the space spanned by, the fingers;

f. differentiating devices that have undergone step e. wherein the length of all of the leads on the two sides of the device that have traversed the fingers are within said tolerance from those wherein the length of at least one of the leads on either one of said two sides is not within said tolerance by identifying the devices whose leads depress all of the fingers aligned with the leads on said sides twice as those that have leads that are within tolerance and any device whose leads fail to depress at least one of the fingers aligned with its leads twice as rejects;

g. rotating the devices identified in step f. as those whose leads are within tolerance through 90 degrees; and h. repeating steps d. through f.

5. A method as in claim 4 wherein the fingers of step b. are spaced-apart from each adjacent other finger by a distance that is substantially equal to the distance that each lead is spaced-apart from each adjacent other lead on the same side of the device.

6. A method as in claim 4 wherein the width of the fingers of step b. is less than the width of the leads of the device.

7. A fixture for determining if the lengths of all of the leads of all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said fixture comprising:

smooth surface means disposed for advancing said device thereacross;

a plurality of finger means in over-lapping alignment affixed to the surface means with each finger means protruding from the surface means by an amount equivalent to the selected tolerance, said plurality of finger means being in number at least equivalent to the number of leads on the longest side of the device;

means for supporting the surface means at a selected angle to horizontal;

means for defining a position on the surface means so as to place each of the leads on two of the sides of the device closest to the finger means opposite a different one of the finger means when the device is placed on the surface means in the defined position;

means for differentiating devices that have been advanced across the surface means wherein the length of all of the leads on the two sides that have traversed the finger means are within said tolerance from those wherein the length of at least one of the leads on either one of the two sides is not within said tolerance; and means for rotating the devices identified by the differentiating means as those being within tolerance through 90 degrees.

8. A fixture as in claim 7 wherein:

said surface means has a straight bottom edge on which it rests when supported by the supporting means; and said plurality of finger means are affixed substantially parallel to the bottom edge of the surface means.

9. A fixture as in claim 8 wherein each finger means of said plurality of finger means are oriented across the face of the surface means in a stair-step fashion and spaced-apart from each adjacent other finger means of the plurality of finger means by a distance that is substantially equal to the distance that each lead is spaced-apart from each adjacent other lead on the same side of the device.

10. A fixture as in claim 7 wherein said means for differentiating distinguishes the devices that traverse a number of finger means equivalent to the number of leads on one of said sides as within tolerance and any devices that fall from the finger means before having traversed a number of finger means equivalent to the number of leads on one of said sides as rejects.

11. A fixture for determining if the lengths of all of the leads of all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said fixture comprising:

smooth surface means disposed for advancing said device thereacross;

a plurality of spaced-apart, linearly aligned, finger means mounted rotatabally to the surface means to protrude therefromabove by an amount equivalent to the selected tolerance, said plurality of finger means being at least equivalent in number to the number of leads on the longest side of the device;

means for supporting the surface means at a selected angle to horizontal;

means for defining a position on the surface means above the finger means so as to place each of the leads on a side of the device closest to the finger means opposite a different one of the finger means when the device is placed on the surface means in the defined position;

means for differentiating devices that have been advanced across the surface means wherein the length of all of the leads on the two sides that have traversed the finger means are within said tolerance from those wherein the length of at least one of the leads on either one of said two sides of the device is not within said tolerance; and means for rotating the devices identified by the differentiating means as those whose leads on the first two sides of the device are within tolerance through 90 degrees.

12. A fixture as in claim 11 wherein each finger means of the plurality of finger means is spaced-apart from each adjacent other finger means by a distance that is substantially equal to the distance that each lead is spaced-apart from each adjacent other lead on the same side of the device.

13. A fixture as in claim 12 wherein the width of each of the finger means is less than the width of the leads of the device.

14. A fixture as in claim 11 wherein said differentiating means includes means for identifying the devices whose leads depress all of the finger means aligned with the leads on said sides twice as those that have leads that are within tolerance and any device whose leads fail to depress at least one of the finger means aligned with its leads twice as rejects.

15. A method for determining if the lengths of all of the leads on all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said method comprising the steps of:

a. providing a relatively smooth surface across which the device is to be advanced;

b. affixing a first plurality of fingers in over-lapping alignment to the surface of step a. with each finger protruding from said surface by an amount equivalent to the selected tolerance, said first plurality of fingers being in number equivalent to the number of leads on one of the first two sides of the device to be tested;

c. affixing a second plurality of fingers in linear alignment with, and spaced-apart from, said first plurality of fingers and in over-lapping alignment with each other to the surface of step a. with each finger protruding from said surface by an amount equivalent to the selected tolerance, said second plurality of fingers being in number equivalent to the number of leads on one of the second two sides of the device to be tested;

d. supporting the surface of step a. at a selected angle to horizontal;

e. defining a first position on the surface so as to place each of the leads on the first two of the sides of the device closest to the fingers of the first plurality of fingers opposite a different one of the fingers when the device is placed on the surface in the first defined position, said first position being juxtaposed the first plurality of fingers of step b. with a first of the fingers of the first plurality over-lapping said first position;

f. defining a second position intermediate said first and second pluralities of fingers on the surface so as to place each of the leads on the second two of the sides of the device closest to the fingers of the second plurality of fingers opposite a different one of the fingers when the device is placed on the surface in the second defined position, with the last finger of the first plurality of fingers over-lapping one end of the second position and the first finger of the second plurality over-lapping an other end of the second position;

g. advancing the device from the first defined position of step e. across the surface in the direction of, and across the spaced spanned by, the first plurality of fingers;

h. differentiating devices that have undergone step g. wherein the length of all of the leads traversing the first plurality of fingers are within said tolerance from those wherein the length of at least one of the leads on either one of the first two sides is not within said tolerance by identifying the devices that traverse said first plurality of fingers and arrive at the second defined position of step f. as those that have leads on the first two sides of the device that are within tolerance and any devices that fall from the first plurality of fingers before having traversed all of said first plurality of fingers as rejects;

i. rotating the devices identified in step h. as being within tolerance through 90 degrees intermediate the one and the other ends of the second position;

j. advancing the device from the second defined position of step f. across the surface in the direction of, and across the space spanned by, the second plurality of fingers; and k. differentiating devices that have undergone step j. wherein the length of all of the leads traversing the second plurality of fingers are within said tolerance from those wherein the length of at least one of the leads on either one of the second two sides is not within said tolerance by identifying the devices that traverse said second plurality of fingers as those that have leads that are within tolerance on all four sides and any devices that fall from the second plurality of fingers before having traversed all of said second plurality of fingers as rejects.

16. A method as in claim 15 wherein:

said surface of step a. has a straight bottom edge on which it rests when supported as in step d.; and said fingers of steps b. and c. are affixed substantially parallel to the bottom edge of the surface.

17. A method as in claim 16 wherein the fingers of each of the first and second plurality of fingers are oriented across the face of the surface in a stair-step fashion and spaced-apart from each adjacent other finger within the same plurality by a distance that is substantially equal to the distance that each lead is spaced-apart from each adjacent other lead on the same side of the device.

18. A method for determining if the lengths of all of the leads on all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said method comprising the steps of:

a. providing a relatively smooth surface across which the device is to be advanced;

b. mounting rotatablly a first plurality of spaced-apart, linearly aligned, fingers to said surface to protrude therefromabove by an amount equivalent to the selected tolerance, said first plurality of fingers being at least equivalent in number to the number of leads on the first two sides to be tested of the device;

c. mounting rotatabally a second plurality of spaced-apart, linearly aligned, fingers to said surface to protrude therefromabove by an amount equivalent to the selected tolerance, said second plurality of fingers being at least equivalent in number to the number of leads on the second two sides to be tested of the device;

d. supporting the surface of step a. at a selected angle to horizontal;

e. defining a first position on the surface above the first plurality of fingers of step b. so as to place each of the leads on one side of the first two sides of the device closest to the fingers opposite a different one of the fingers when the device is placed on the surface in the first defined position;

f. defining a second position on the surface below the first plurality of fingers of step b. and above the second plurality of fingers of step c. so as to place each of the leads on one side of the second two sides of the device closest to the fingers opposite a different one of the fingers when the device is placed on the surface in the second defined position;

g. advancing the device from the first position of step e. across the surface in the direction of, and across the space spanned by, the first plurality of fingers;

h. rotating the devices through 90 degrees;

i. advancing the device from the second position of step f. across the surface in the direction of, and across the space spanned by, the second plurality of fingers; and j. differentiating devices that have undergone steps g. and i. wherein the length of all of the leads on all four sides of the device are within said tolerance from those wherein the length of at least one of the leads on any one of the four sides of the device is not within said tolerance by identifying the devices whose leads depress all of the fingers aligned with the leads on said sides twice in each of the first and second pluralities of fingers as those that have leads that are within tolerance and any device whose leads fail to depress at least one of the fingers aligned with its leads twice in each of said first and second pluralities of fingers as rejects.

19. A method as in claim 18 wherein the fingers of steps b. and c. are spaced-apart from each adjacent other finger within its respective plurality of fingers by a distance that is substantially equal to the distance that each lead is spacedapart from each adjacent other lead on the same side of the device.

20. A method as in claim 18 wherein the width of the fingers of steps b. and c. is less than the width of the leads of the device.

21. A fixture for determining if the lengths of all of the leads of all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said fixture comprising:

smooth surface means disposed for advancing said device thereacross;

a first plurality of finger means in over-lapping alignment affixed to the surface means with each finger means protruding from the surface means by an amount equivalent to the selected tolerance, said first plurality of finger means being in number equivalent to the number of leads on one of the first two sides of the device to be tested;

a second plurality of finger means in linear alignment with, and spaced-apart from, said first plurality of finger means and in over-lapping alignment with each other on the surface means with each finger means of the second plurality of finger means protruding from said surface means by an amount equivalent to the selected tolerance, said second plurality of finger means being in number equivalent to the number of leads on one of the second two sides of the device to be tested;

means for supporting the surface means at a selected angle to horizontal;

means for defining a first position on the surface means so as to place each of the leads on the first two of the sides of the device closest to the finger means of the first plurality of finger means opposite a different one of the finger means when the device is placed on the surface means in the first defined position, said first defined position being juxtaposed the first plurality of finger means with a first of the finger means of the first plurality of finger means over-lapping said first defined position;

means for defining a second position on the surface means intermediate said first and second pluralities of finger means on the surface means so as to place each of the leads on the second two of the sides of the device closest to the finger means of the second plurality of finger means opposite a different one of the finger means when the device is placed on the surface means in the second defined position, with the last finger means of the first plurality of finger means over-lapping one end of the second position and the first finger means of the second plurality of finger means over-lapping an other end of the second position; and means for rotating the devices at the second position through 90 degrees.

22. A fixture as in claim 21 wherein:

said surface means has a straight bottom edge on which it rests when supported by the supporting means; and said first and second plurality of finger means are affixed substantially parallel to the bottom edge of the surface means.

23. A fixture as in claim 22 wherein each finger means of said first and second pluralities of finger means are oriented across the face of the surface means in a stair-step fashion and spaced-apart from each adjacent other finger means of the corresponding first and second plurality of finger means by a distance that is substantially equal to the distance that each lead is spaced-apart from each adjacent other lead on the same side of the device.

24. A fixture as in claim 21 wherein the devices that traverse said first and second pluralities of finger means are those devices that have all of the leads on all four sides within said tolerance and any devices that fall from the first or second pluralities of finger means are rejects.

25. A fixture for determining if the lengths of all of the leads of all four sides of a PLCC packaged device are within a selected tolerance of each other wherein each lead on each side of the device is substantially in alignment with another lead on the adjacent parallel side of the device and on each side of the device each lead is spaced-apart from each adjacent other lead by substantially the same distance, said fixture comprising:

smooth surface means disposed for advancing said device thereacross;

a first plurality of spaced-apart, linearly aligned, finger means mounted rotatabally to the surface means to protrude therefromabove by an amount equivalent ot the selected tolerance, said first plurality of finger means being at least equivalent in number to the number of leads on one of the first two sides of the device to be tested;

a second plurality of spaced-apart, linearly aligned, finger means mounted rotatabally to the surface means to protrude therefromabove by an amount equivalent to the selected tolerance, said second plurality of finger means being at least equivalent in number to the number of leads on one of the second two sides of the device to be tested;

means for supporting the surface means at a selected angle to horizontal;

means for defining a first position on the surface means above the first plurality of finger means so as to place each of the leads on one side of the first two sides of the device closest to the finger means opposite a different one of the finger means when the device is placed on the surface means in the first defined position;

means for defining a second position on the surface means below the first plurality of finger means and above the second plurality of finger means so as to place each of the leads on one side of the second two sides of the device closest to the finger means opposite a different one of the finger means when the device is placed on the surface in the second defined position;

means for differentiating devices that have been advanced across the surface means wherein the length of all of the leads on each of the two sides that have traversed each the first and second plurality of finger means, respectfully, are within said tolerance from those wherein the length of at least one of the leads on any one of said four sides of the device is not within said tolerance; and means for rotating the devices in the second position 90 degrees.

26. A fixture as in claim 25 wherein each finger means of each of the first and second plurality of finger means is spaced-apart from each adjacent other finger means within the corresponding plurality of finger means by a distance that is substantially equal to the distance that each lead is spaced-apart from each adjacent other lead on the same side of the device.

27. A fixture as in claim 26 wherein the width of each of the finger means of each of the first and second pluralities of finger means is less than the width of the leads of the device.

28. A fixture as in claim 25 wherein said differentiating means includes means for identifying the devices whose leads depress all of the finger means aligned with the leads on said sides twice as those that have leads that are within tolerance and any device whose leads fail to depress at least one of the finger means aligned with its leads twice as rejects.

* * * * *